US007770769B2

(12) United States Patent
Hurn

(10) Patent No.: US 7,770,769 B2
(45) Date of Patent: Aug. 10, 2010

(54) ADJUSTABLE RUCKSACK HARNESS

(75) Inventor: Martyn Hurn, Cumbria (GB)

(73) Assignee: Lowe Alpine Holdings Limited, Cumbria (GB)

( * ) Notice: Subject to any disclaimer, the term of this patent is extended or adjusted under 35 U.S.C. 154(b) by 600 days.

(21) Appl. No.: 11/596,136

(22) PCT Filed: May 10, 2005

(86) PCT No.: PCT/EP2005/005138

§ 371 (c)(1),
(2), (4) Date: Jul. 10, 2007

(87) PCT Pub. No.: WO2005/107519

PCT Pub. Date: Nov. 17, 2005

(65) Prior Publication Data

US 2008/0035695 A1 Feb. 14, 2008

(30) Foreign Application Priority Data

May 11, 2004 (GB) ..... 0410428.7

(51) Int. Cl.
*A45F 3/04* (2006.01)

(52) U.S. Cl. ..... 224/631; 224/627; 224/628; 224/641; 224/579

(58) Field of Classification Search ..... 224/578, 224/579, 627, 628, 629, 631, 632, 633, 634, 224/635, 636, 638, 639, 640, 641; D3/216; 244/142, 151 R, 151 A
See application file for complete search history.

(56) References Cited

U.S. PATENT DOCUMENTS 5,449,102 A * 9/1995 Sason ..... 224/632
5,725,139 A 3/1998 Smith et al.
5,971,244 A * 10/1999 Jaeger ..... 224/632
6,364,729 B1 * 4/2002 Khanamirian ..... 441/115

FOREIGN PATENT DOCUMENTS

CH 678 796 A 11/1991
DE 3045881 7/1982
DE 8716869 3/1988

(Continued)

*Primary Examiner*—Nathan J Newhouse
*Assistant Examiner*—Steven M Landolfi, Jr.
(74) *Attorney, Agent, or Firm*—Katten Muchin Rosenman LLP

(57) ABSTRACT

The invention relates to a rucksack harness comprising central adjustment means (6) located on an upper part of a rear wall of a rucksack; and a central web (8) adjustably attached to the rear wall of the rucksack by the central adjustment means (6), the central web (8) running downwardly along the length of the rucksack to a branch point (4) at which the central web (8) is bifurcated to form to a pair of side webs (10), the pair of side webs (10) passing first through a pair of loops (12) positioned at either side of a lower part of the rear wall of the rucksack, and then passing upwardly along either side of the rucksack and under a stabilizing member (14) or spreader plate, the ends of the pair of side webs being attached to a pair of shoulder carrier straps (16), wherein the length of the shoulder carrier straps (16) in relation to the rear of the rucksack may be adjusted by pulling the end of the central web (8) through the central adjustment means (6).

14 Claims, 4 Drawing Sheets

FOREIGN PATENT DOCUMENTS

| | | | | |
|---|---|---|---|---|
| DE | 9211744 | | | 11/1992 |
| DE | 19932499 | A1 | * | 2/2001 |
| EP | 0173024 | | | 3/1986 |
| GB | 2130481 | A | * | 6/1984 |
| WO | 94/26143 | | | 11/1994 |
| WO | WO 9708971 | A1 | * | 3/1997 |

* cited by examiner

ADJUSTABLE RUCKSACK HARNESS

This application is a National Phase of International Application No. PCT/EP2005/005138, filed May 10, 2005, which claims the benefit under 35 U.S.C. 119(a-e) of GB 0410428.7 filed May 11, 2004, which is herein incorporated by reference.

FIELD OF THE INVENTION

The present invention relates to a rucksack harness, and more particularly to a rucksack harness which is adjustable to fit individual back lengths. The term "rucksack" as used throughout the description and claims is intended to include backpacks and other bags carried on the shoulder by means of a shoulder harness.

BACKGROUND TO THE INVENTION

The ladder style of construction of rucksack harness adjustment systems is well known. One known system is the PARALUX (Trade Mark) suspension system. Many modifications and variations of this system are currently available on the high grade rucksack and climbing equipment market. The PARALUX™ system is known for its ruggedness, durability and stability in use. Some modifications of this system have similar performance to the PARALUX™ system but usually comprise expensive alternative components.

In the PARALUX™ suspension system a plurality of transverse webs are sewn in ladder-like fashion to the back wall of the rucksack. The shoulder straps terminate in a strap which is threaded through a selected one of the webs depending on the desired location of the shoulder straps. The strap is then threaded through a buckle and tightened, threaded under the next highest ladder web, through a web on the shoulder harness, and then threaded through a further ladder web. The loose end of the strap is pushed down behind the ladder configuration. Finally, a top stabilizer web is threaded through buckles at the top of the ladder to stabilize the connection.

A known disadvantage of the ladder type adjustment system is its relative complexity. A rucksack owner may easily forget how to adjust the system to account for different loads or different users. Additionally, at points of sale, adjustment of a rucksack to fit a number of customers is time consuming and off-putting to both the customer and retailer.

German Gebrauchsmuster No. G 92 11 744.9 discloses a rucksack comprising a backpack having at an upper region of the back wall two carrier straps, which are height-adjustably secured to the back wall. A plurality of transverse loops or webs are stitched to the back wall of the backpack in spaced apart and ladder-like fashion. The shoulder straps are joined together by a yoke, and a plate attached to the yoke is inserted behind a selected loop and is locked in position by means of a snap fastener.

German Patent Application No. DE 3045881 discloses a height-adjustable system for attaching a carrying harness to a rucksack in which a number of transverse bands or webs are sewn to the rear wall of the rucksack to form a ladder-like construction similar to the PARALUX™ system described above. The transverse bands are sewn to the rear wall by means of stitches which extend in a v-shape, to provide for varying shoulder widths.

International Patent Application No. PCT/IE94/00027 describes an alternative adjustment system, known as the APS™. This system comprises a pair of shoulder straps connected together at a yoke. The rear wall of the rucksack is provided with a plurality of overlapping slats, which define a plurality of open-ended pockets or sleeves. The user selects a pocket corresponding to the desired location of the shoulder straps. The yoke is then held in position in the chosen pocket by a tie strap, which is fastened to a buckle located below the series of pockets.

All of the above systems suffer from a common disadvantage, that is, the level of adjustment available to the user is limited by the number and spacing of the webs, loops or pockets provided on the rear wall of the rucksack. Each of the systems provides a varying degree of adjustment, but in each case the shoulder straps may only be located at a finite number of discrete locations on the back of the rucksack, which may result in a level of discomfort for some users.

Mechanical means are known for adjusting the height of the shoulder harness on rucksacks, typically in which the yoke connecting the shoulder harness slides in vertically arranged runners or tracks on the back wall of the rucksack, and is locked in place by a locking system. Known mechanical systems include the TORSO TRAC™ suspension system (U.S. Pat. No. 4,860,936), and the systems described, for example, in European Patent 0,173,024 and German Gebrauchsmuster No. G 87 16 869.3. While these mechanical systems offer a quick and easy method of height adjustment they are expensive to manufacture. Also there is a tendency for the yoke to slip and the locking system can cause problems.

OBJECT OF THE INVENTION

It is an object of the present invention to seek to alleviate the above disadvantages and to provide an improved harness system which is easy to use, allows an infinite number of adjustment positions and which is relatively inexpensive to manufacture.

SUMMARY OF THE INVENTION

According to the present invention there is provided a rucksack harness comprising central adjustment means located on an upper part of a rear wall of a rucksack; and a central web adjustably attached to the rear wall of the rucksack by the central adjustment means, the central web running downwardly along the length of the rucksack to a branch point at which the central web is bifurcated to form to a pair of side webs, each side web passing first through a respective guide means, one positioned at either side of a lower part of the rear wall of the rucksack, and then passing upwardly of the rear wall of the rucksack, the ends of the pair of side webs being connected to a pair of shoulder carrier straps, wherein the length of the shoulder carrier straps in relation to the rear of the rucksack may be adjusted by pulling an end of the central web through the central adjustment means.

The rucksack harness of the present invention allows the user to position the shoulder straps at an infinite number of possible positions between a fully extended and a fully contracted position. The level of adjustment is not provided in discrete steps, and all users can therefore be accommodated comfortably, regardless of their back length. A further advantage of the harness is the simplicity with which it may be adjusted. A user is not required to be familiar with the operation of rucksacks or rucksack harnesses in general in order to operate the harness of the present invention.

Advantageously, the shoulder carrier straps are linked by a stabilising member or spreader plate. In a preferred embodiment, the side webs are attached to the stabilising member. The stabilising member may comprise a sheet of plastics material.

Preferably, the central adjustment means is an adjustable buckle attached to the rear wall by a short strap. According to another preferred feature of the invention, the central web is provided with markings to give an indication of the selected back length.

Ideally, the rucksack harness further comprises a stiff frame sheet for attachment to the rear wall of the rucksack. According to one embodiment of the rucksack harness, the guide means comprise loops formed from a plastic material and are attached to the lower part of the rear wall of the rucksack by straps.

According to a preferred embodiment of the invention, the rucksack harness further comprises a sleeve defined by at least one price of suitable material attached along the length of the rear wall of the rucksack, such that the side webs and the central web are at least partially encased in the sleeve. Optionally, the guide means are also encased in the sleeve.

According to a further preferred feature of the invention, the rucksack harness comprises a pair of padded ridges connected to the rear wall of the rucksack in a substantially vertical parallel spaced-apart arrangement, such that a vertical air channel is created therebetween. Ideally, a piece of open weave fabric is connected to the rear wall of the rucksack, such that it bridges the pair of padded ridges and the vertical air channel. Suitably, the fabric is a breathable mesh material. This arrangement allows air to circulate between the rucksack and a user's back.

Ideally, the shoulder carrier straps are attached at their lower ends to a waist belt which is adapted to be fastened around the waist of a user of the rucksack.

DETAILED DESCRIPTION OF THE DRAWINGS

Figure 1:
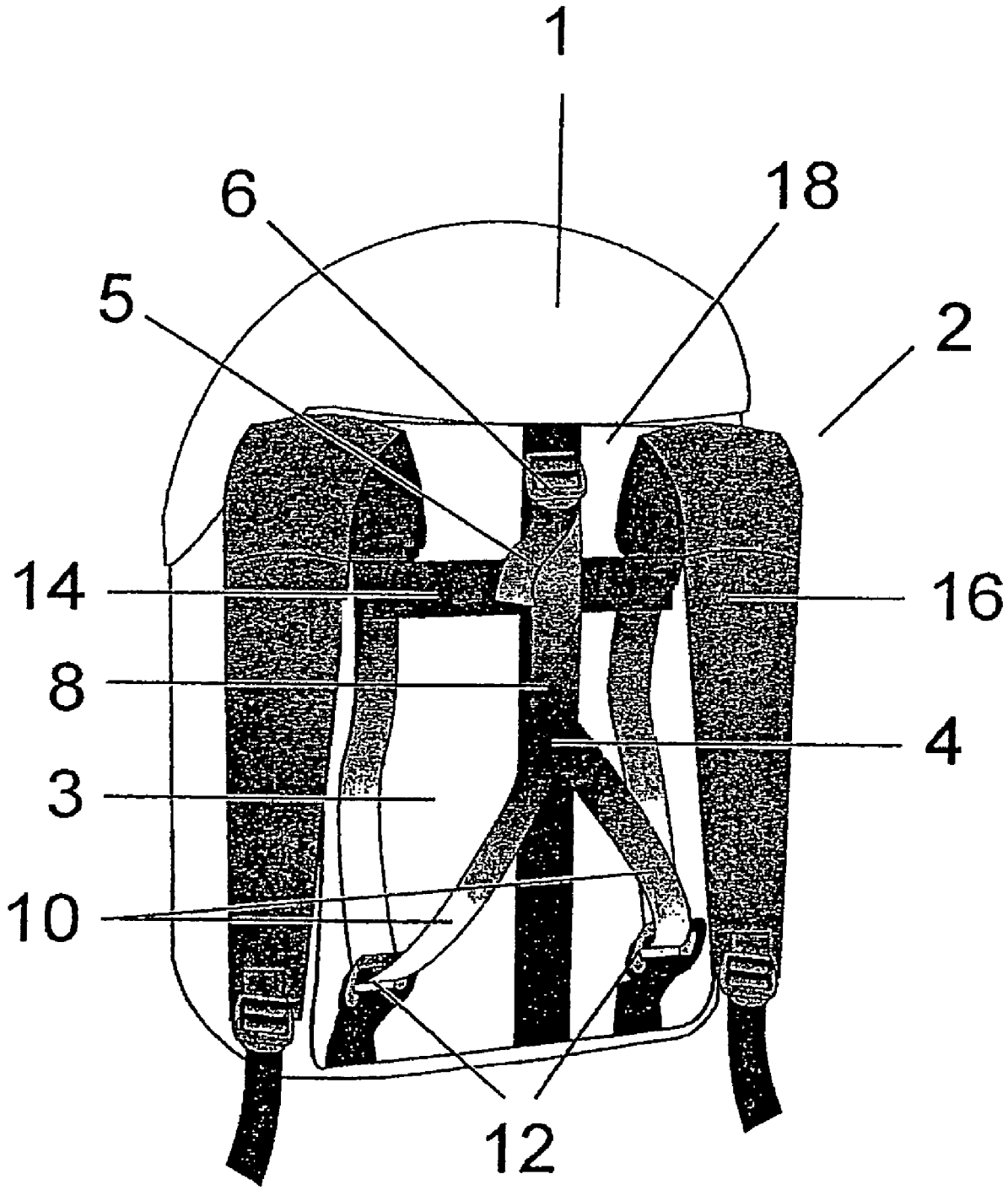
FIG. 1 is a perspective view of a rucksack incorporating a rucksack harness according to a first embodiment of the present invention.

Referring to FIG. 1 of the drawings, a rucksack 1 incorporating a rucksack harness 2 according to a first embodiment of the present invention is shown. The rucksack harness comprises a central buckle 6 located at an upper part of a rear wall 3 of the rucksack 1 and attached to the rear of the rucksack by a strap or other suitable means. The harness further comprises a central web 8 comprising a length of flexible webbing material for example, nylon webbing. The central web 8 is attached to the rear wall 3 of the rucksack by the central buckle 6 in which a top end 5 of the central web 8 is adjustably engaged in well-known manner by threading the web through the apertures in the buckle. From the buckle 6, the central web 8 runs downwardly, and substantially vertically, along the length of the rucksack to a branch point 4. At the branch point 4, the web is bifurcated to form two side webs 10. Thus, when seen in elevation it is of substantially inverted Y-shape. The side webs run through a pair of guide loops 12 and then pass upwardly along either side of the rucksack and are attached at their ends to a pair of shoulder carrier straps 16. The shoulder carrier straps 16 are linked by a transverse stabilising member 14. In the embodiment shown, the stabilising member 14 is a sheet of plastics material. In the embodiment of FIG. 1, the rucksack harness also comprises a stiff frame sheet 18 for attachment to the rear wall of the rucksack.

The rucksack harness allows the location of the shoulder carrier straps to be adjusted in relation to the rear of the rucksack by pulling on the free end 5 of the central web 8, so that it passes through the buckle 6. Pulling the free end 5 of the web 8 causes the branch point 4 to move upwards in relation to the rucksack. This in turn pulls the ends of the side webs 10 downwards, thus effectively shortening the shoulder carrier straps. This allows the rucksack to be carried comfortably by a user having with a relatively short back length. To allow the rucksack to be used by an individual with a longer back length, the free end of the central web 8 may be fed through the central buckle 6, causing the branch point 4 to move downwards, so that the side webs are fed through the loops and the shoulder straps are effectively lengthened. The central buckle 6 is a locking buckle such that the central web 8 is not permitted to slip. The buckle 6 may be substituted by a slim profile self-locking fastener, or similar device.

Figure 2:
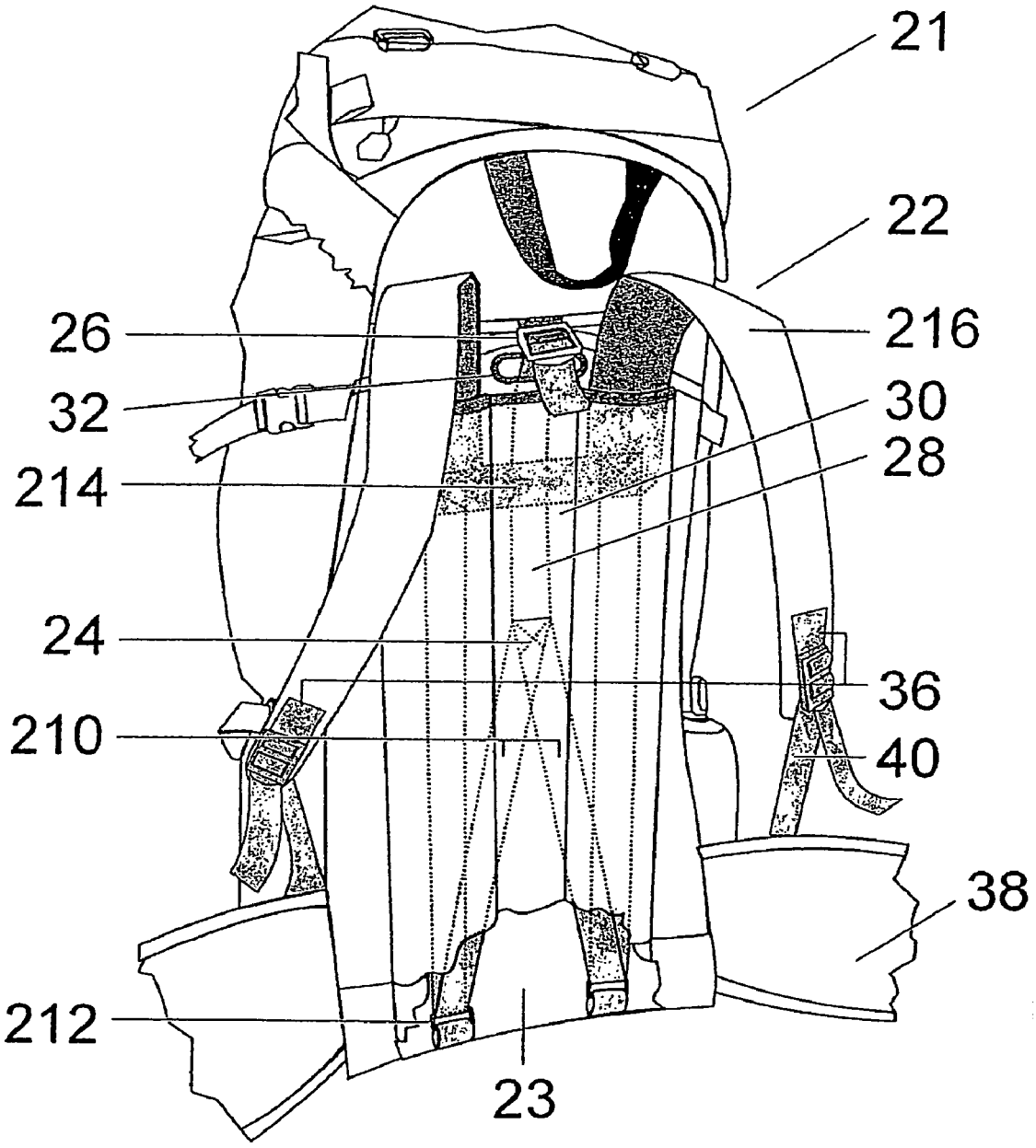
FIG. 2 is a perspective view of a rucksack incorporating a rucksack harness according to a second embodiment of the invention.
Figure 3:
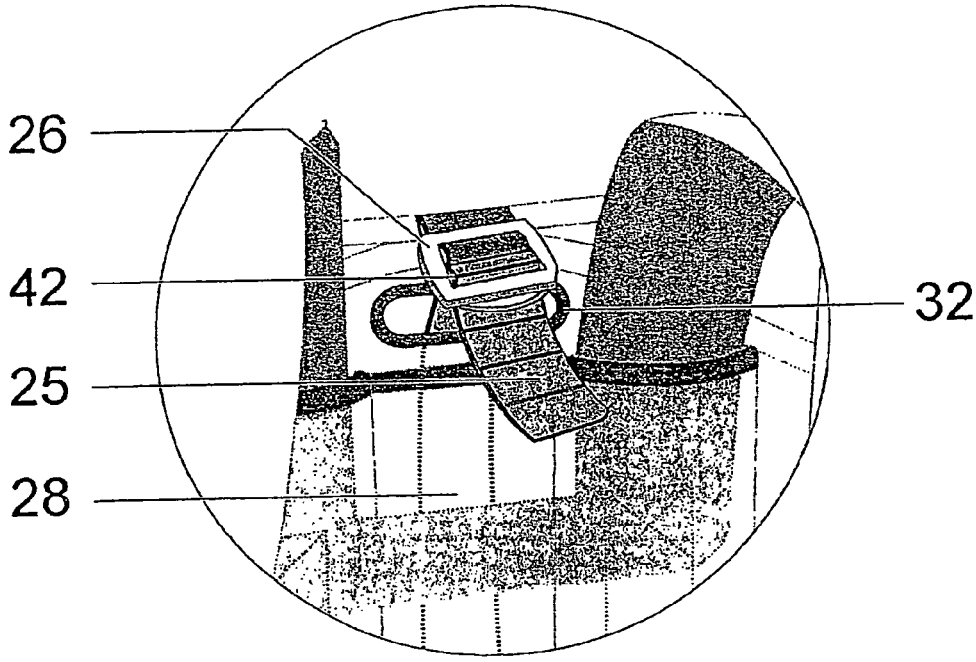
FIG. 3 is a detail view of one feature of the rucksack harness.
Figure 6:
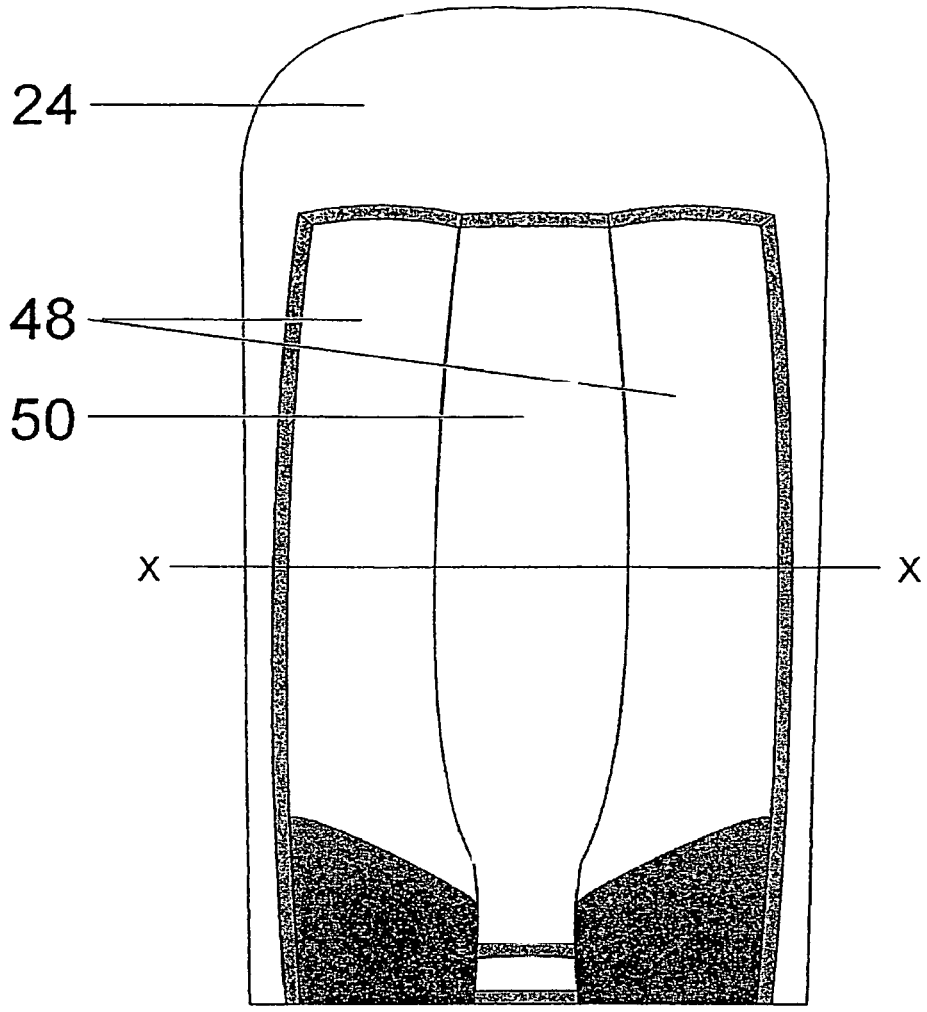
FIG. 6 is a rear view of a rucksack incorporating a rucksack harness according to the present invention.
Figure 7:
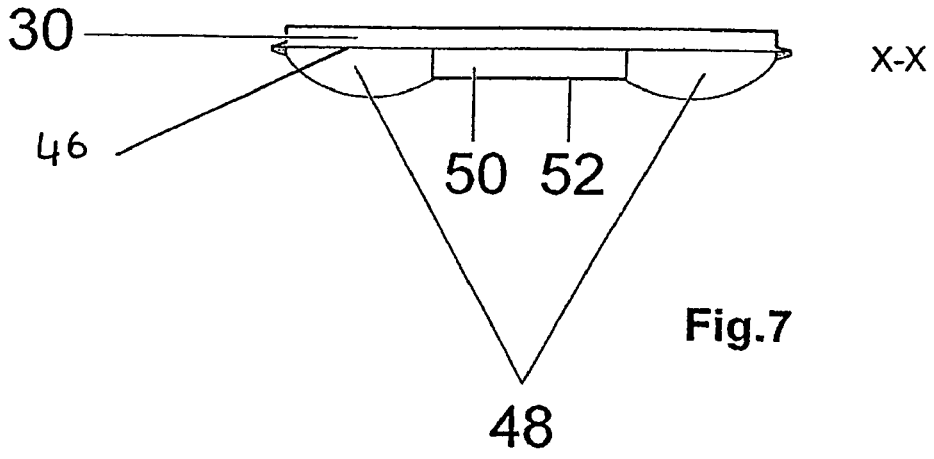
FIG. 7 is a cross-section along line X-X of FIG. 6.

A rucksack 21 incorporating a preferred embodiment of the rucksack harness 22 of the present invention is shown in FIGS. 2 and 3. The rucksack harness 22 comprises a central buckle 26 located at an upper part of a rear wall 23 of the rucksack 21 and attached to the rear of the rucksack by a short strap. The harness further comprises a central web 28 attached to the rear wall 23 of the rucksack by the central buckle 26. The central web 28 runs downwardly, under a stabilising member 214 and along the length of the rucksack to a branch point 24. At the branch point 24, the web is bifurcated to form two side webs 210. The side webs 210 run through a pair of guide loops 212 and then pass upwardly along either side of the rucksack and are attached at their upper ends to a pair of shoulder carrier straps 216. As shown in FIGS. 6 and 7, the central web 28 and each side web 210 and corresponding guide loop 212 are encased in a sleeve 30 defined by a piece of material 46 stitched to the rear wall 24 of the rucksack. A pair of padded ridges 48 run along the rear wall of the rucksack in a substantially vertical parallel spaced-apart arrangement, and a vertical air channel 50 is defined between them. FIG. 3 shows the central web 28 entering the sleeve 30 via aperture 32. The stabilising member or spreader plate 214 also lies within the sleeve 30. A piece of open-weave breathable mesh fabric 52 bridges the pair of padded ridges 48 and the vertical air channel 50. The shoulder carrier straps 216 are linked by the stabilising member 214. The stabilising member 214 ensures that an equal adjustment is applied to each shoulder strap. The shoulder carrier straps are attached at their lower ends 36 to a waist belt 38, by means of straps 40. The waist belt is intended to be fastened around the waist of a user of the rucksack 21, thereby transferring a large portion of the weight of the load to the user's hips.

Figure 4:
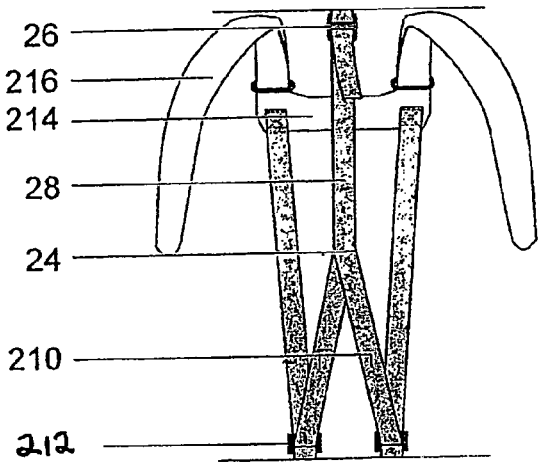
FIGS. 4 and 5 are rear views of a rucksack harness according to the present invention.
Figure 5:
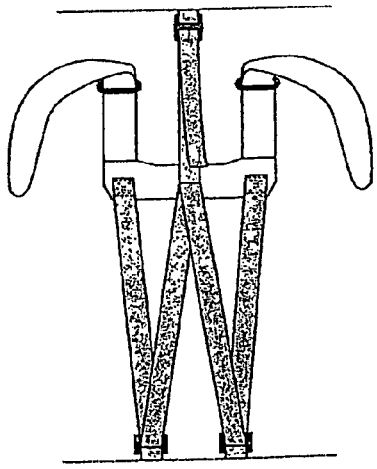

The rucksack harness of this preferred embodiment allows the shoulder straps to be adjusted in the same way as described above for the first embodiment, as illustrated in FIGS. 4 and 5. Pulling the free upper end 25 of the central web 28 causes the branch point 24 to move upwards in relation to the rucksack. This in turn pulls the ends of the side webs downwards, thus effectively shortening the shoulder carrier straps 216, allowing the rucksack to be carried comfortably by a user with a relatively short back length as illustrated in FIG. 5. To allow the rucksack to be used by an individual with a longer back length, the free end 25 of the central web 28 may be fed through the central buckle 26, causing the branch point

24 to move downwards, so that the side webs 210 are fed through the loops 212 and the shoulder straps are effectively lengthened as shown in FIG. 4. As shown in FIG. 3, the central web 28 is provided with markings, e.g. coloured lines, to give an indication of the selected back length. A different colour of marking may be used to denote different adjustment positions.

The stabilising member 14 may be made from a suitable elastomeric material. The webbing material from which the webs 8 and 10 are manufactured, may be polypropylene, or polyester nylon.

In an alternative embodiment, the rucksack is provided with a substantially inverted U-shaped frame having a central portion and two substantially vertical side arms. The frame is attached to the rear wall of the rucksack and each side web is attached to a side arm of frame by means of at least one loop of webbing. In this embodiment, the stabilising member or spreader plate is provided on the outside of the rear wall of the rucksack. Padding may be provided on an outer surface of the stabilising member, such that it lies between the stabilising member and the back of a user when the rucksack is in use.

It will of course be understood that the invention is not limited to the specific details described herein, which are given by way of example only, and that various modifications and alterations are possible within the scope of the invention.

Where technical features mentioned in any claim are followed by reference signs, these reference signs have been included for the sole purpose of increasing the intelligibility of the claims and accordingly, such reference signs to not have any limiting effect on the scope of each element identified by way of example by such reference signs.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A rucksack harness comprising:

central adjustment means located on an upper part of a rear wall of a rucksack; and a central web adjustably attached to the rear wall of the rucksack by the central adjustment means, the central web running downwardly along the length of the rucksack to a branch point at which the central web is bifurcated to form to a pair of side webs, each side web passing first through a respective guide means, one positioned at either side of a lower part of the rear wall of the rucksack, and then passing upwardly of the rear wall of the rucksack and under a stabilising member, ends of the pair of side webs being connected to a pair of shoulder carrier straps, wherein the length of the shoulder carrier straps in relation to the rear of the rucksack may be adjusted by pulling an end of the central web through the central adjustment means.

2. A rucksack harness as claimed in claim 1, wherein the shoulder carrier straps are linked by a stabilising member.

3. A rucksack harness as claimed in claim 2, wherein the side webs are attached to the stabilising member.

4. A rucksack harness as claimed in claim 2, wherein the stabilising member comprises a sheet of plastics material.

5. A rucksack harness as claimed in claim 1, wherein the central adjustment means is an adjustable buckle attached to the rear wall by a strap.

6. A rucksack harness as claimed in claim 1, further comprising a stiff frame sheet for attachment to the rear wall of the rucksack.

7. A rucksack harness as claimed in claim 1, wherein the guide means comprise loops formed from a plastic material and attached to the lower part of the rear wall of the rucksack.

8. A rucksack harness as claimed in claim 1, further comprising a sleeve defined by at least one piece of suitable material attached along the length of the rear wall of the rucksack, such that the side webs and the central web are at least partially encased in the sleeve.

9. A rucksack harness as claimed in claim 8, wherein the guide means are encased in the sleeve.

10. A rucksack harness as claimed in claim 8, further comprising a pair of padded ridges connected to the rear wall of the rucksack in a substantially vertical parallel arrangement, such that a vertical air channel is created therebetween.

11. A rucksack harness as claimed in claim 10, further comprising a piece of open weave fabric connected to the rear wall of the rucksack such that it bridges the pair of padded ridges and the vertical air channel.

12. A rucksack harness as claimed in claim 11, wherein the fabric is a breathable mesh material.

13. A rucksack harness as claimed in claim 1, wherein the shoulder carrier straps are attached at their lower ends to a waist belt which is adapted to be fastened around the waist of a user of the rucksack.

14. A rucksack harness as claimed in claim 1, wherein the central web is provided with markings to give an indication of the selected back length.

* * * * *